US010538945B2

(12) United States Patent
Jeffries

(10) Patent No.: US 10,538,945 B2
(45) Date of Patent: Jan. 21, 2020

(54) LATCH FOR A CABINET

(71) Applicant: Austin Hardware & Supply, Inc., Lee's Summit, MO (US)

(72) Inventor: Mark Steven Jeffries, Buford, GA (US)

(73) Assignee: Austin Hardware And Supply, Inc., Lee's Summit, MO (US)

( * ) Notice: Subject to any disclaimer, the term of this patent is extended or adjusted under 35 U.S.C. 154(b) by 0 days.

(21) Appl. No.: 15/892,873

(22) Filed: Feb. 9, 2018

(65) Prior Publication Data

US 2018/0230723 A1 Aug. 16, 2018

Related U.S. Application Data

(60) Provisional application No. 62/458,906, filed on Feb. 14, 2017.

(51) Int. Cl.

| | |
|---|---|
| ***E05C 3/12*** | (2006.01) |
| ***E05C 3/14*** | (2006.01) |
| ***E05C 3/00*** | (2006.01) |

(52) U.S. Cl.

CPC ..... *E05C 3/124* (2013.01); *E05C 3/008* (2013.01); *E05C 3/14* (2013.01)

(58) Field of Classification Search

CPC ... E05C 3/22; E05C 3/165; E05C 3/14; E05C 3/124; E05C 3/008; E05C 19/002; E05B 63/0052; E05B 65/44

See application file for complete search history.

(56) References Cited

U.S. PATENT DOCUMENTS

| | | | | |
|---|---|---|---|---|
| 4,428,153 | A * | 1/1984 | Klinger | E05C 19/002 49/310 |
| 9,388,609 | B2 * | 7/2016 | Grela | E05C 3/14 |
| 2006/0103278 | A1 * | 5/2006 | Bousquet | B25H 3/028 312/332.1 |
| 2018/0073290 | A1 * | 3/2018 | Jeffries | E05B 65/44 |
| 2018/0195323 | A1 * | 7/2018 | Cho | E05B 83/32 |
| 2018/0245383 | A1 * | 8/2018 | Jeffries | E05C 3/008 |

* cited by examiner

*Primary Examiner* — Daniel J Rohrhoff

(74) *Attorney, Agent, or Firm* — Polsinelli PC

(57) ABSTRACT

A latch for a cabinet is described. The latch may be used to secure a door of the cabinet in a closed position. The latch includes a pawl member that pivots or rotates relative to a pivot plate. The pawl member includes a pawl tip generally opposite of a pawl fulcrum end. The latch includes a striker. The pawl member engages and disengages with the striker. The latch includes a handle that is configured to move. The handle includes an upper end. The upper end is configured to contact the pawl lever end to cause the pawl member to pivot or rotate relative to the pivot plate to disengage the pawl member from the striker.

19 Claims, 8 Drawing Sheets

LATCH FOR A CABINET

CROSS REFERENCE TO RELATED APPLICATION

This application claims the benefit of U.S. Provisional Patent Application 62/458,906 filed Feb. 14, 2017, which is hereby incorporated by reference.

FIELD OF INVENTION

The present invention relates to a latch for a cabinet.

SUMMARY

A latch for a cabinet is described. The latch may be used to secure a door of the cabinet in a closed position. The door hingedly connects to a frame of the cabinet. The door may include sliding panels to cover an opening of the cabinet. A combination hinged door with the sliding panels may be used to cover the opening of the cabinet. This type of hinged door is commonly called a restocking closure.

The latch for the cabinet is well suited for use in cabinets on emergency vehicles, such as ambulance, fire trucks, etc. The cabinets may be used for storage on such vehicles. The door may be used to close the cabinets and prevent the contents of the cabinet from falling out of the cabinet. The latch secures the door in a closed position over the cabinet.

The latch for the cabinet may be used with the restocking closures, which includes a hinged cabinet door with built-in sliding closures. This allows for the cabinet to be completely opened for restocking the cabinet, and also allows the cabinet to be accessed by sliding the closures, such as Plexiglas panels, to an open position for immediately retrieval of items from the cabinet.

The latch for the cabinet includes a handle that may be accessed from an exterior of the cabinet. The handle releases the latch such that the hinged cabinet door may be opened. There is no need for the operator to reach into the cabinet or through the door in order to release the latch. In a latched position, i.e., the hinged cabinet door is closed and latched, the handle is positioned outside of the cabinet. For example, in the latched position, the handle is positioned in front of a lower wall of the cabinet and below a lower edge of the door.

In one aspect, a latch for a cabinet is described. The latch includes a pawl member that pivots or rotates relative to a pivot plate. The pawl member includes a pawl tip generally opposite of a pawl fulcrum end. The latch includes a striker. The pawl member engages and disengages with the striker. The latch includes a handle that is configured to move. The handle includes an upper end. The upper end is configured to contact the pawl lever end to cause the pawl member to pivot or rotate relative to the pivot plate to disengage the pawl member from the striker. The handle, pivot plate, and pawl member are installed on a door of the cabinet, while the striker is installed on the cabinet. The latch holds the door in a locking or latching engagement with the cabinet to maintain the door in the closed position. A user may press or squeeze on the handle causing the upper end of the handle to press against the pawl lever end, which releases the pawl member from the striker.

In another aspect, a latch for a cabinet is described. The latch includes a pawl member that pivots relative to a base member. The pawl member includes a pawl tip generally opposite of a pawl lever end. A handle member is configured to move. The handle member includes an upper end. The upper end is configured to contact the pawl lever end to cause the pawl member to pivot relative to the base member and to lower the pawl tip. The pawl member and the base member are engaged to the cabinet. A door is hingedly connected to the cabinet. The handle member is engaged to the door. The pawl tip is configured to secure into a groove of the door.

In another aspect, a latch for a cabinet is described. The latch includes a pawl member that pivots relative to a base member. The pawl member includes a pawl tip generally opposite of a pawl lever end. The pawl member includes a lower surface. The pawl member includes a pawl axle positioned between the pawl tip and the pawl lever end. A handle member includes an upper end. The upper end is linked to the pawl lever end to drive the pawl member. The handle, the pawl member, and the base member are engaged, linked or attached to a lower wall of the cabinet, and the pawl tip is configured to secure into a groove of the door.

DETAILED DESCRIPTION OF INVENTION

Figure 1:
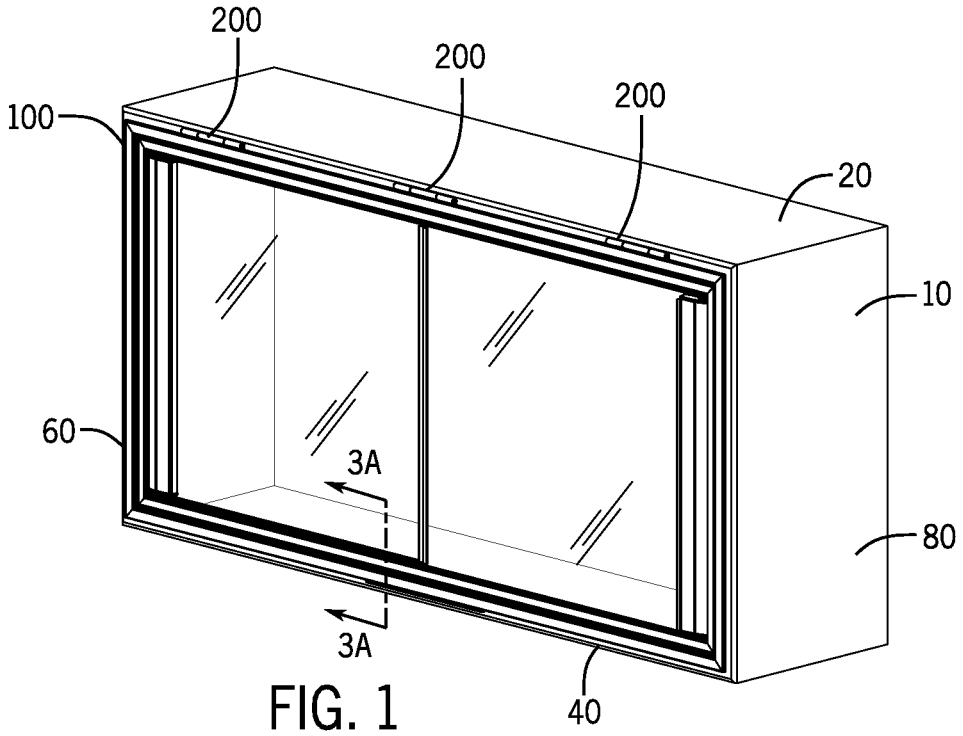
FIG. 1 is a perspective view of the door engaged to the cabinet via a hinge.
Figure 2:
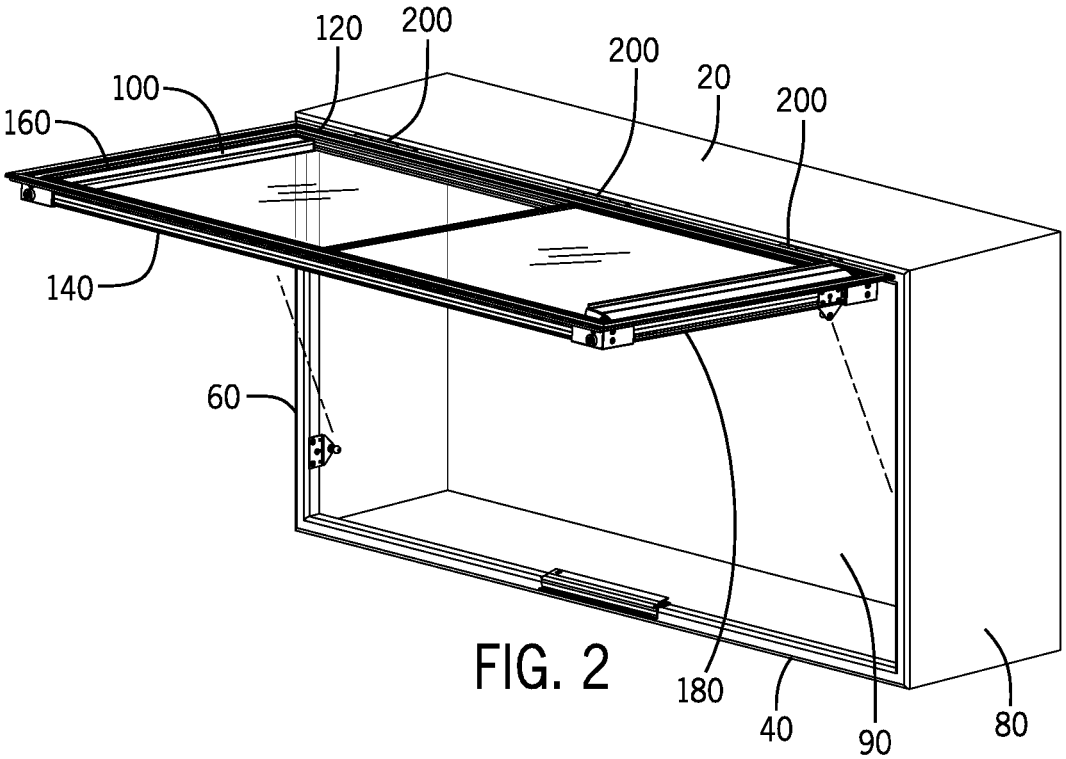
FIG. 2 is a perspective view of the door engaged to the cabinet via the hinge with the door in an open position.

With reference to FIGS. 1 and 2, a cabinet 10 and a door 100 are shown. The door 100 hingedly engages to a front of the cabinet 10 via a hinge 200. One or more hinges 200 may hingedly connect the door 100 to the cabinet 10.

The cabinet includes an upper wall 20 opposite of a lower wall 40 and a left side wall 60 opposite of a right side wall 80. The walls 20, 40, 60, and 80 may be fastened together with or without a rear wall 90. The door 100 may include conventional construction or may be formed from multiple frame sections, like the door 100. The door 100 includes an upper frame section 120 opposite of a lower frame section 140 and a left frame section 160 opposite of a right frame section 180. The cabinet 10 may be formed to have a generally rectangular or square shape. One or more gas-springs may be incorporated between the cabinet 10 and the door 100 to control the opening and closing of the frame 100.

The hinge 200 includes a central portion, a first lateral portion, and a second lateral portion. The first and second lateral portions engage to the cabinet 10. The central portion engages to the door 100. The hinge 200 provides for the door 100 to move between open and closed positions. The door 100 includes multiple sliding panels to further open and close access to the cabinet 10.

Figure 3A:
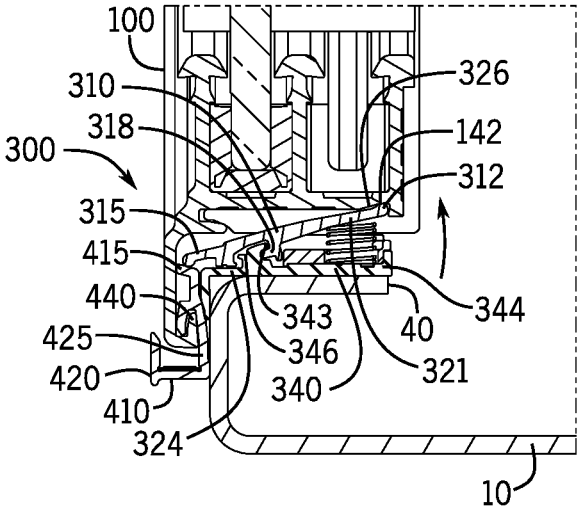
FIG. 3A is a view of the first latch in a latched position.
Figure 3B:
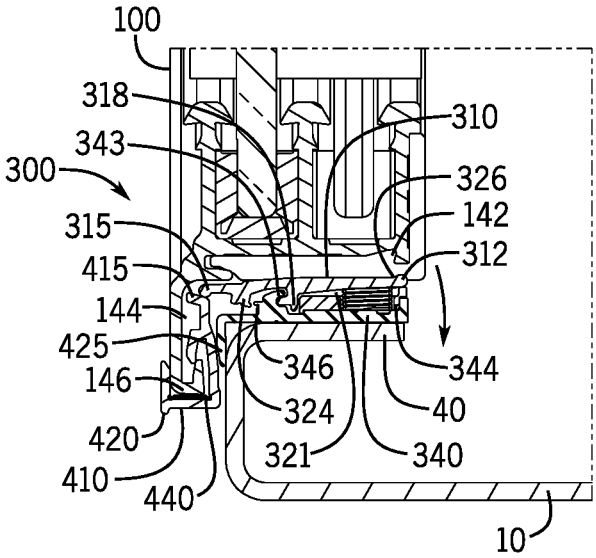
FIG. 3B is a view of the first latch releasing from the latched position.

A first latch 300 will now be described with reference to FIGS. 3-4. The first latch 300 secures the door 100 in a closed position. The first latch 300 includes a pawl member 310, a base member 340, and a handle 410. The pawl member 340 pivots relative to the base member 340. The handle 410 slides or moves relative to the door 100. The handle 410 contacts the pawl member 310 to move the pawl member 310 to an unlatched position. The handle 410 is movably engaged to the door 100, while the pawl member 310 and the base member 340 are engaged to the lower wall 40 of the cabinet 10.

In this aspect, the handle 410 completely disengages from the pawl member 310 when the door 100 is sufficiently opened from the cabinet 10. A user may unlatch the first latch 300 using a single hand that presses upward on the handle 410, which releases the pawl member 310. Then, the user may pull on the handle 410 to open the door 100 to the cabinet 10, as the handle 410 moves with the door 100.

The first latch 300 includes a decoupled design—in that the handle 410 becomes completely separated, removed, distanced, etc. from the pawl member 310 when the first latch 300 is unlatched and the door 100 is opened. The handle 410 moves with the door 100, while the pawl member 310 and the base member 340 remain engaged to the cabinet 10. The handle 410 may contact the pawl member 310 during a closing of the door 100, but the handle 410 is not mechanically attached or integrated with the pawl member 310.

The pawl member 310 includes a pawl tip 312 generally opposite of a pawl lever end 315. The pawl member 310 includes a lower surface 321. The pawl member 310 also includes a pawl axle 318 positioned between the pawl tip 312 and the pawl lever end 315 and extending downward from the lower surface 321. The pawl member 310 rotates upward and downward with respect to the pawl axle 318. The pawl member 310 also includes a locking lip 324 extending downward from the lower surface 321. As described below, the locking lip 324 assists in holding the pawl member 310 to the base member 340.

The base member 340 engages to the lower wall 40 of the cabinet 10 and holds the pawl member 310 in a biased and pivoting engagement. Fasteners 347 affix the base member 340 to the lower wall. The base member 340 includes springs 344 that urge against the lower surface 321 of the pawl member 310. The springs 344 bias the pawl tip 312 towards a bottom of the door 100. The springs 344 urge the pawl tip 312 upwards to lockingly engage to the door 100.

The base member 340 includes one or more end blocks 370, which house the springs 343. The end blocks 370 may include cylindrical openings 371 to contain the springs 343 and control their biasing force. In other aspects, the springs 343 may be integrated or attached directly to the base member 340. The ends blocks 370 also include a rear surface 373, which prevents over rotation and forward movement of the pawl member 310, which together prevent unhinging.

The base member 340 includes a bearing surface 343 that receives the pawl axle 318. The pawl axle 318 rotates relative to the bearing surface 343. The base member 340 further includes a locking lip 346 that interacts with the locking lip 324 of the pawl member 310. In the aspect shown, the locking lip 324 of the pawl member 310 is positioned between the pawl lever end 325 and the pawl axle 318. When the pawl member 310 is installed to the base member 340, the locking lip 324 is forced past the locking lip 346, which snap-fits the pawl axle 318 against the bearing surface 343 of the base member 340.

When the user desires to open the cabinet 10, the user must unlatch the first latch 300. The user pushes the handle 410 upward, which causes the pawl member 310 to move to the unlatched position. The door 100 may now be opened. When the user pushes the handle 410 upward, an upper end 415 of the handle 410 presses against the pawl lever end 315, which raises or lifts the pawl lever end 315. As the pawl lever end 315 is raised or lifted, the pawl tip 312 is simultaneously lowered and is eventually removed from a groove 142 of the lower frame section 140 of the door 100. This unlatches the door 100 from the cabinet 10. As such, the door 100 may now be opened. The groove 142 may be formed as part of the extrusion used in making the lower frame section 140. The groove 142 is formed in a lower surface 144 of the lower frame section 140. In other aspects, the groove 142 or other catches, openings, receiving, parts, etc. may be formed in lower or bottom surfaces of standard doors.

The handle 410 is movably engaged to the door 100 and moves relative to the door 100. In the aspect shown, the handle 410 is configured to move toward a center of the door 100. In the aspect shown, the handle 410 moves generally vertically. The handle 40 includes a gripping region 420 generally opposite of the upper end 415 of the handle 410. The gripping region 420 transitions into a generally vertical portion 425 that leads into the upper end 415. A retaining portion 430 extends from the vertical portion 425. An opening 435 is formed between the retaining portion 430 and the vertical portion 425. The opening 435 receives a flange portion 440 of the door 110. As the handle 410 moves upward or downward, the opening 435 moves away from or over the flange portion 440. These structures assist in guiding the movement of the handle 410. The flange portion 440 and an inner surface 144 of the lower frame section 140 also forms a channel 146 that receives the retaining portion 430. These structures also assist in guiding the movement of the handle 410.

Figure 3C:
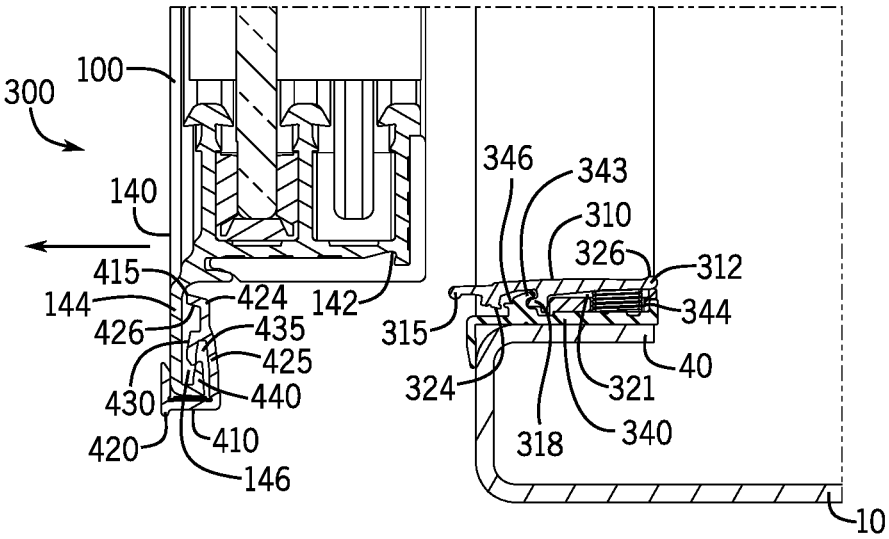
FIG. 3C is a view of the first latch in an open position.
Figure 4:
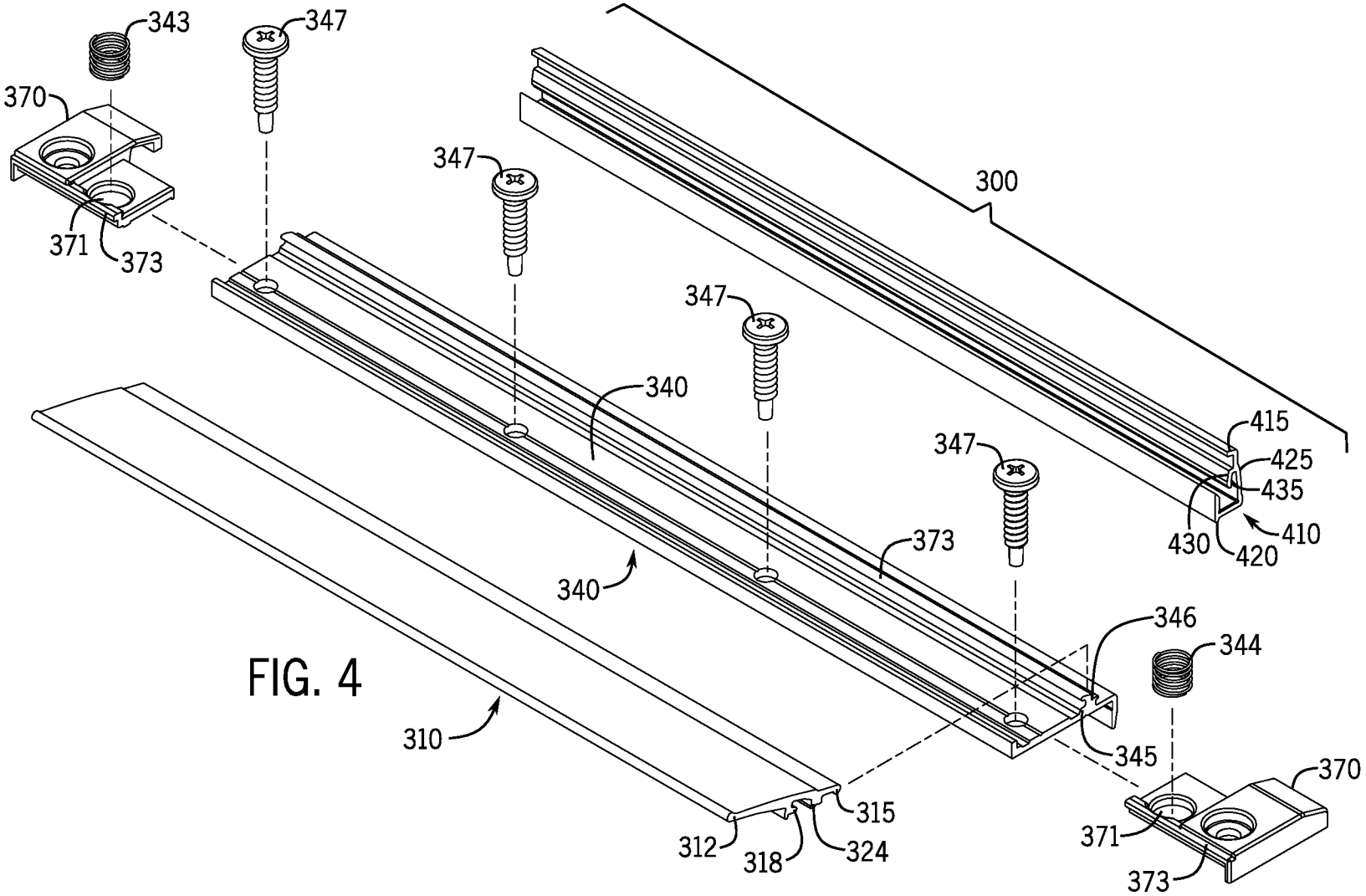
FIG. 4 is an exploded view of the first latch.

As shown in FIG. 3C, the upper end 415 of the handle 410 includes a flattened upper surface 424 and a lateral portion 426. The lateral portion 426 extends toward the inner surface 144 of the lower frame section 140. As the handle 410 moves upward and downward, the lateral portion 426 may slide against the inner surface 144.

In order to latch the door 100 in the closed position, the door 100 is moved to the closed position. The lower surface 144 of the lower frame section 140 presses against an upper surface 326 of the pawl tip 312 of the pawl member 310, which causes the pawl tip 312 to move downward and thus overcoming the biasing force from the springs 343. As the door 100 is further moved to the closed position, the pawl tip 312 will eventually seat into the groove 142 of the lower frame section 140 of the door 100 when the door 100 is sufficiently closed. The force from the springs 343 holds the pawl tip 312 in the groove 142.

The first latch 300 includes the handle 410 that may be accessed from an exterior of the cabinet 10. The handle 410 releases the first latch 300 such that the door 100 may be opened by hinging upward. There is no need for the operator to reach into the cabinet 10 in order to release the first latch 300. In a latched position, i.e., wherein the door 100 is closed and latched, the handle 410 is positioned outside of the cabinet 10. For example, in the latched position, the handle 410 is positioned in front of the lower wall 40 of the cabinet 10. Portions of the handle 410, including the gripping region 420 are positioned exterior to the door 100 and the cabinet 10. The gripping region 420 may protrude from a bottom, front surface of the cabinet 10, providing convenient access to the operator to release the first latch 300. The gripping region 420 may extend beyond a front surface of the door 100 or its lower frame section 140.

Figure 5A:
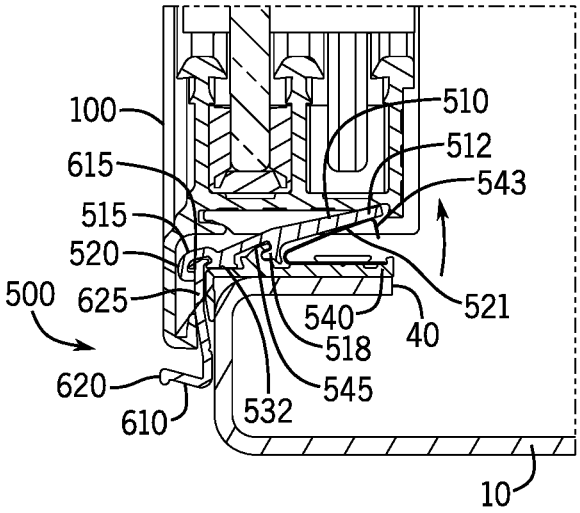
FIG. 5A is a view of the second latch in a latched position.
Figure 5B:
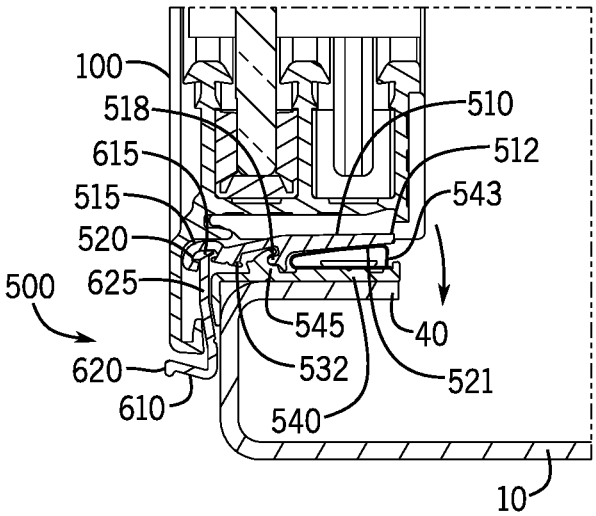
FIG. 5B is a view of the second latch releasing from the latched position.
Figure 5C:
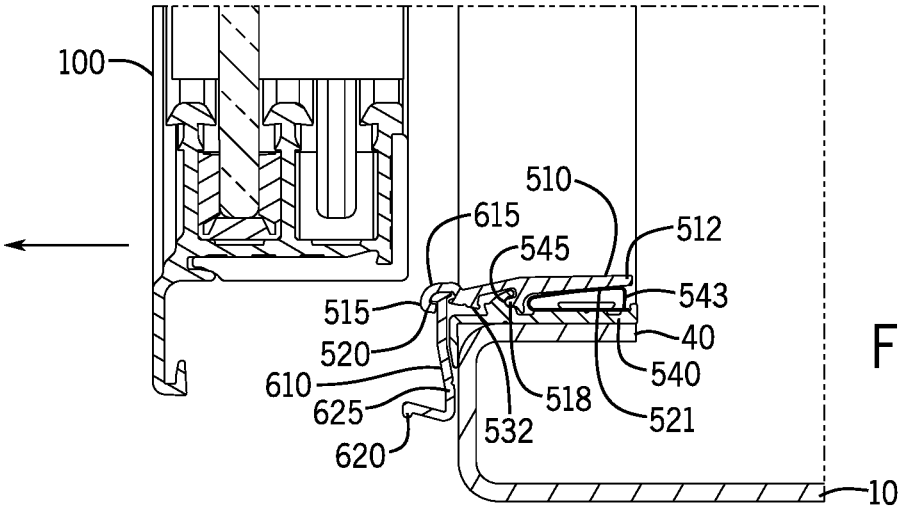
FIG. 5C is a view of the second latch in an open position.
Figure 6:
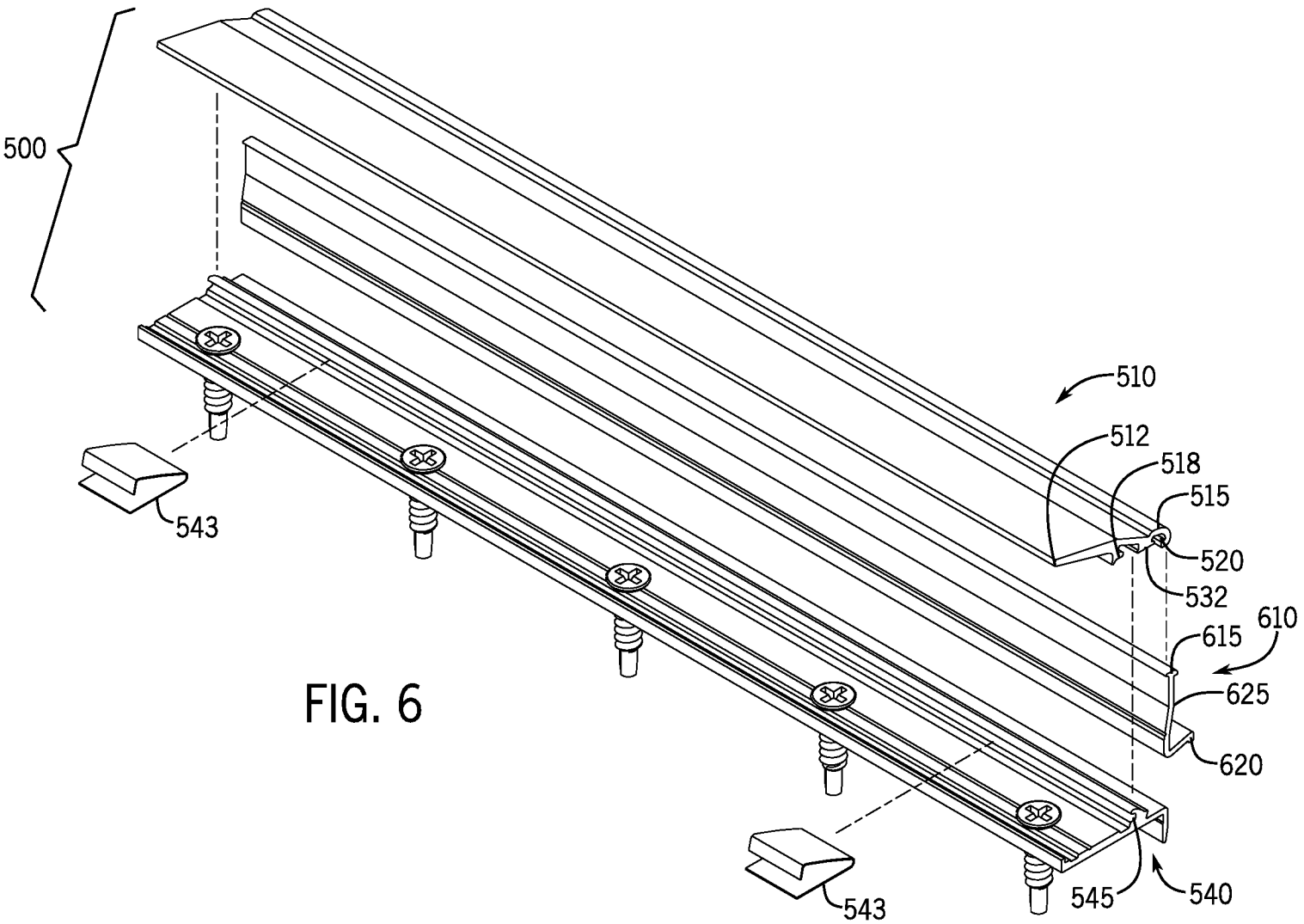
FIG. 6 is an exploded view of the second latch.

A second latch 500 will now be described with reference to FIGS. 5-6. The second latch 500 also secures the door 100 in a closed position. The second latch 500 includes a pawl member 510, a base member 540, and a handle 610. The pawl member 510 pivots relative to the base member 540. The handle 610 is linked to the pawl member 510 and moves or drives the pawl member 510 to cause the pivoting of the pawl member 510 relative to the base member 540. The base member 540 is affixed or engaged to the lower wall 40 of the cabinet 10.

A user may unlatch the second latch 500 by pressings upward on the handle 610, which releases the pawl member 510. Then, the user may pull on the door 100 to open the door 100 to the cabinet 10. When the door 100 is opened, the handle 610, the pawl member 510 and the base member 540 remain engaged, linked or otherwise attached to the cabinet 10. The handle 610 does not move with the door 100.

The pawl member 510 includes a pawl tip 512 generally opposite of a pawl lever end 515. The pawl lever end 515 forms a receiving portion 520 that receives an upper end 615 of the handle 610. The receiving portion 520 forms a socket or opening that receives the upper end 615. The upper end 615 may move or articulate within the receiving portion 520. The upper end 615 may drive the lever end 515 in an upward movement.

The pawl member 510 further includes a lower surface 521. The pawl member 510 also includes a pawl axle 518 positioned between the pawl tip 512 and the pawl lever end 525 and extending downward from the lower surface 521. The pawl member 510 rotates upward and downward with respect to the pawl axle 518. The lower surface 521 further includes a stop member 532 that prevents over-rotation of the pawl member 510. The stop member 532 is positioned between the pawl axle 518 and the lever end 515. The pawl tip 512 may rotate upward, under the forces of the springs 543, until the stop member 532, which is moving downwards, contacts an upper surface 542 of the base member 540.

The base member 540 engages to the lower wall 40 of the cabinet 10 and holds the pawl member 510 in a biased and pivoting engagement. The base member 540 includes the springs 543 that urge against the lower surface 521 of the pawl member 510. The springs 543 urge the pawl tip 512 upwards to lockingly engage the door 100.

The base member 540 includes a bearing surface 545 that receives the pawl axle 518. The pawl axle 518 rotates relative to the bearing surface 545.

When the user desires to open the cabinet 10, the user must unlatch the second latch 500. The user pushes the handle 610 upward, which causes the pawl member 510 to move to the unlatched position. The door 100 may now be opened. When the user pushes the handle 610 upward, the upper end 615 of the handle 610 presses against the pawl lever end 515, which raises or lifts the pawl lever end 515. As the pawl end 515 is raised or lifted, the pawl tip 512 is simultaneously lowered and is eventually removed from the groove 142 of the lower frame section 140 of the door 100. As such, the door 100 may now be opened. The groove 142 may be formed as part of the extrusion used in making the lower frame section 140. The groove 142 is formed in the lower surface 144 of the lower frame section 140 of the door 100.

The handle 610 includes a gripping region 620 generally opposite of the upper end 615 of the handle 610. The gripping region 620 transitions into a generally vertical portion 625 that leads into the upper end 615.

In order to latch the door 100 in the closed position, the door 100 is moved to a closed position. The lower surface 144 of the lower frame section 140 presses against an upper surface 526 of the pawl tip 512 of the pawl member 510, which causes the pawl tip 512 to move downward and thus overcoming the force from the springs 543. The pawl tip 512 will seat into the groove 142 of the lower frame section 140 of the door 100 when the door 100 is sufficiently closed. The force from the springs 543 holds the pawl tip 512 in the groove 142.

The second latch 500 includes the handle 610 that may be accessed from an exterior of the cabinet 10. The handle 610 releases the second latch 500 such that the door 100 may be opened by hinging upward. There is no need for the operator to reach into the cabinet 10 in order to release the second latch 500. In both latched position and unlatched positions, the handle 610 is positioned outside of the cabinet 10. The handle 610 is positioned in front of the lower wall 40 of the cabinet 10. Portions of the handle 610, including the gripping region 620 are positioned exterior to the door 100 and the cabinet 10. The gripping region 620 may protrude from a bottom, front surface of the cabinet 10, providing convenient access to the operator to release the first latch 300. The gripping region 620 may extend beyond a front surface of the door 100 or its lower frame section 140.

A third latch 700 will now be described with reference to FIGS. 7, 8A, 8B, 8C, and 9. The third latch 700 secures the door 100 in a closed position. The third latch 700 includes a pawl member 710, a striker 740, a pivot plate 750, and a handle 810. The pivot plate 750 holds the pawl member 710 in a pivotal or rotatable engagement. The pawl member 710 is biased toward the striker 740. The pawl member 710 pivots or rotates relative to the pivot plate 750 in order to engage with the striker 740. The handle 810 slides or moves relative to the door 100 when the user presses or urges the handle 810 upward or toward a flange portion 440 along a lower edge of the door 100. The handle 810 contacts the pawl member 710 to move the pawl member 710 to an unlatched or disengaged position. The handle 810, the pawl member 710, and the pivot plate 750 are engaged to the door 100 and move with door 100 when the door 100 is opened, while the striker 740 is engaged to the lower wall 40 of the cabinet 10 in a fixed or stationary position relative to the cabinet 10.

In this aspect, the pawl member 710 completely disengages from the striker 740 when the door 100 is sufficiently opened from the cabinet 10. A user may unlatch the third latch 700 using a single hand that presses upward on the handle 810, which releases the pawl member 710 from the striker 740. The pawl member 710 moves with the opening of the door 100. The striker 740 remains engaged to the cabinet 10. Then, the user may pull on the handle 810 or other portion of the door 100 to open the door 100 to the cabinet 10, as the handle 810 moves with the door 100. When the user presses upward on the handle 810 to release the pawl member 710 from the striker 740, the pawl member 710 rotates or pivots relative to the pivot plate 750.

The pawl member 710 includes a pawl tip 712 generally opposite of a pawl fulcrum end 715. The pawl member 710 includes a catch portion 722 between the pawl tip 712 and the pawl fulcrum end 715. The pawl member 710 includes a lower surface 724. The pawl member 710 rotates upward and downward with respect to the pawl fulcrum end 715. The catch portion 722 also includes a locking lip 728 on the lower surface 724. As described below, the locking lip 728 assists in holding the pawl member 710 to the striker 740.

The striker 740 engages to the lower wall 40 of the cabinet 10. The pivot plate 750 holds the pawl fulcrum end 715 in a pivoting or rotating engagement. The pivot plate 750 defines a socket 752 to pivotally or rotatably hold the fulcrum end 715. The socket 752 includes an opening 754 narrower in dimension than a remainder of the socket 752. During assembly, the fulcrum end 715 is laterally inserted into the socket 752 with a tapered portion 719 of the pawl member 710 passing through the opening 754. One or more springs 760 bias the pawl member 710 to a latching position, i.e., in a downward direction toward the striker 740. The springs 760 urge against an upper surface 718 of the pawl member 710. The springs 760 bias the pawl tip 712 towards the lower wall 40 of the cabinet 10. Fasteners affix the striker 740 to the lower wall 40 of the cabinet 10. The striker 740 may be held or fastened to the cabinet 10 by one or more end blocks 780.

The pivot plate 750 affixes to the groove 142 in a lower edge of the door 100. In the aspect shown, the pivot plate 750 snaps into the groove 142 in the lower edge of the door 100. The groove 142 may be formed as part of the extrusion used in making the lower frame section 140. The groove 142 is formed in a lower surface 144 of the lower frame section 140. In other aspects, the groove 142 or other catches, openings, receiving, parts, etc. may be formed in lower or bottom surfaces of standard doors.

The pawl member 710 includes the catch portion 722. The catch portion may be formed from a curved or arched section in the pawl member 710. The catch portion 722 includes a concave surface 749 that receives the striker 740. The concave surface 749 guides the pawl member 710 to engage its locking lip 728 with the locking tip 745 of the striker 740. The locking tip 745 of the striker 740 may be formed over a concave section 755 of the striker 740. The concave section 755 may receive the locking lip 728 of the pawl member 710. The concave section 755 may include an opening 757 facing a rear of the cabinet 10.

When the user desires to open the cabinet 10, the user must unlatch the third latch 700. The user pushes the handle 810 upward, which causes the pawl member 710 to move to the unlatched position. The door 100 may now be opened. When the user pushes the handle 810 upward, the handle 810 presses against the pawl tip 712, which raises or lifts the pawl tip 712. As the pawl tip 712 is raised or lifted, the locking lip 728 of the pawl member 710 is raised and disengaged from the locking tip 745 of the striker 740. This unlatches the door 100 from the cabinet 10. As such, the door 100 may now be opened.

The locking tip 745 of the striker 740 and the locking lip 728 of the pawl member 710 are formed with contacting surfaces at complementary reverse angles that lockingly engage one another. A force that merely pulls on the door 110 will not normally disengage the locking lip 728 of the pawl member 710 from the locking tip 745 of the striker 740. The actuation of the handle 810 is generally needed to disengage the locking lip 728 of the pawl member 710 from the striker 740. The actuation of the handle raises the pawl tip 712 and also slightly urges the pawl member in rearward direction, i.e., toward a rear of the cabinet 10. This releases the locking lip 728 of the pawl member 710 from the striker 740.

The handle 810 is movably engaged to the door 100. The handle 810 moves toward a center of the door 100. In the aspect shown, the handle 810 moves generally vertically. The handle 810 is biased downward by a spring 815, which may include, for example, one or more leaf springs, coils springs, or other biasing members. A spring 815 may be used on both a left side and a right side of the handle 810. The handle 810 includes a gripping region 820 at a lower portion of the handle 810. When the user pushes the handle 810 upward, the spring 815 is compressed and the handle 810 presses against the pawl tip 712. When the user releases the handle 810, the spring 815 biases the handle 810 downward and away from the pawl tip 712. The handle 810 is held by a channel 446 of the lower frame section 140 of the door 100. Retaining clips 816 hold the handle 810 to the channel 446 and prevent lateral movement of the handle 810.

The handle 810 includes an inner wall 830 and outer wall 860. The inner wall 830 and the outer wall 860 are both generally vertical. The inner wall 830 and the outer wall 860 define an interior space 865, which houses the spring 815. The inner wall 830 transitions into a flattened upper surface 832 and a generally vertical inner portion 834. An opening 836 is formed between the inner wall 830 and the inner portion 834. The opening 836 receives an upwardly extending portion 442 of the flange portion 440 of the door 110. As the handle 810 moves upward or downward, the opening 836 moves away from or toward the upwardly extending portion 442 of the flange portion 440. These structures assist in guiding the movement of the handle 810. The upwardly extending portion 442 of flange portion 440 and an inner surface 144 of the lower frame section 140 also forms the channel 446 that receives the generally vertical inner portion 834. As the handle 810 moves upward and downward, the generally vertical inner portion 834 may enter and retract from the channel 446. Also, as the handle 810 moves upward and downward, an end 833 of the flattened upper surface 832 may slide against an inner surface 147 of the door 110. These structures also assist in guiding the movement of the handle 810 relative to the flange portion 440 of the door 110.

The spring 815 is positioned in the interior space 865 between the inner wall 830 and the outer wall 860. The spring 815 biases against a lower inner surface 867 of the handle 810 and a lower outer surface 444 of the flange portion 440 of the door 110.

Figure 7:
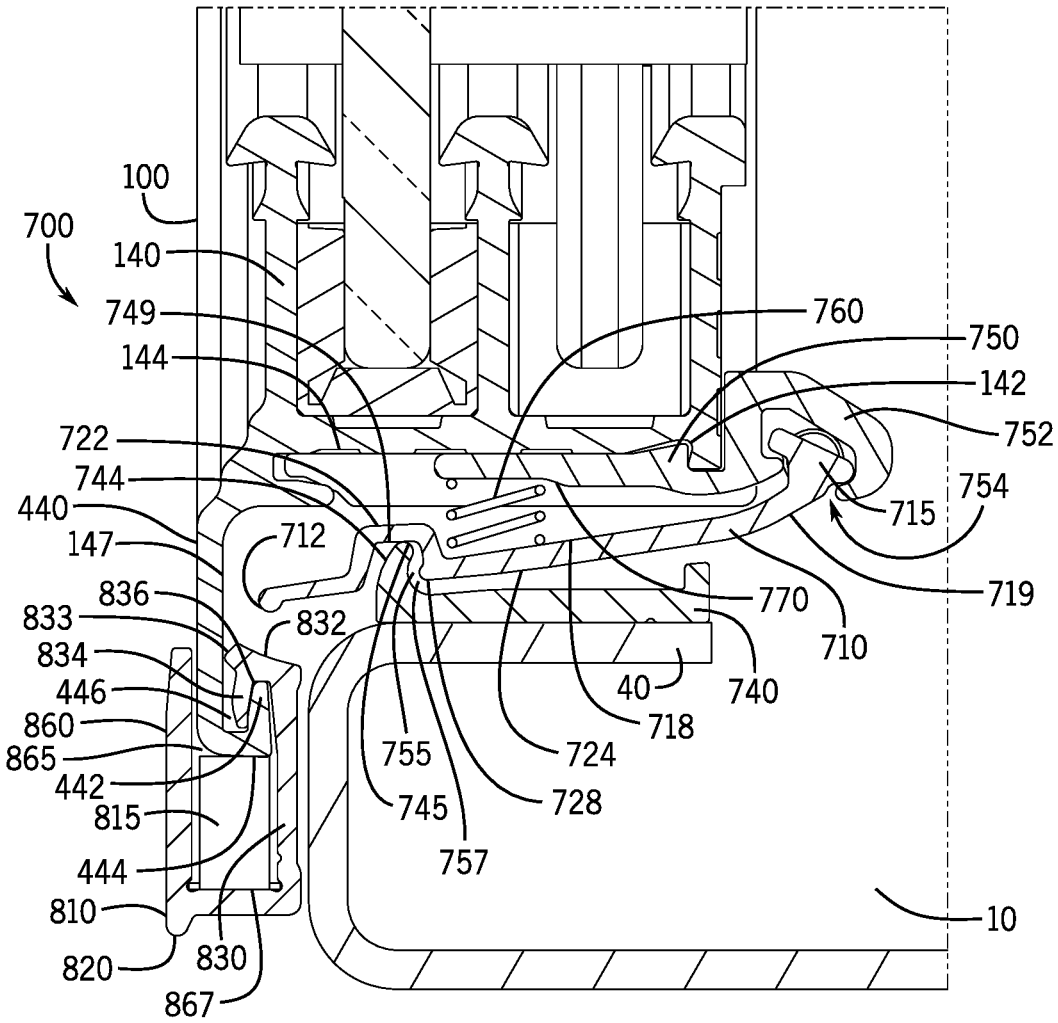
FIG. 7 is a view of the third latch in a latched position.

As shown in FIG. 7, the inner wall 830 of the handle 810 transitions into the flattened upper surface 832. The flattened upper surface 832 of the handle 810 is angled downward towards the cabinet 10. As the flattened upper surface 832 moves upward and contacts the pawl tip 712, the flattened upper surface 832 raises the pawl tip 712, and, due to the downward angle of the flattened upper surface 832, urges the pawl member 710 toward the rear of the cabinet 10.

In order to latch the door 100 in the closed position, the door 100 is moved to the closed position. The pawl member 710 includes the lower surface 724. As the door 100 is closed, the lower surface 724 of the pawl member 710 presses against an upper surface 744 of the striker 740, which causes the pawl member 710 to rotate upward and compress the springs 760. As the door 100 is further moved to the closed position, the upper surface 744 of the striker 740 will seat into the catch portion 722, and the locking lip 728 of the pawl member 710 will engage with the locking tip 745 of the striker 740 when the door 100 is sufficiently closed. The force from the springs 760 holds the locking lip 728 of the pawl member 710 engaged with the locking tip 745 of the striker 740. A lower surface 770 of the pivot plate 750 may include cylindrical openings 781 to contain the springs 760 and control their biasing force. In other aspects, the springs 760 may be integrated or attached directly to the pivot plate 750. The springs 760 bias against the upper surface 718 of the pawl member 710.

The third latch 700 includes the handle 810 that may be accessed from an exterior of the cabinet 10. The handle 810 releases the third latch 700 such that the door 100 may be opened by hinging upward. There is no need for the operator to reach into the cabinet 10 in order to release the third latch 700. In a latched position, i.e., wherein the door 100 is closed and latched, the handle 810 is positioned outside of the cabinet 10. For example, in the latched position, the handle 810 is positioned in front of the lower wall 40 of the cabinet 10. Portions of the handle 810, including the gripping region 820 are positioned exterior to the door 100 and the cabinet 10. The gripping region 820 may protrude from a bottom, front surface of the cabinet 10, providing convenient access to the operator to release the third latch 700. The gripping region 820 may extend beyond a front surface of the door 100 or its lower frame section 140.

Figure 8A:
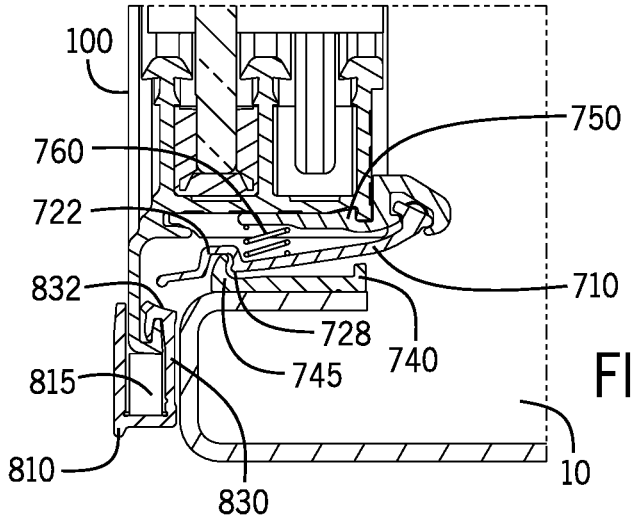
FIG. 8A is a view of the third latch in a latched position.

FIG. 8A is a view of the third latch 700 in a latched position. The springs 760 biases the pawl member 710 to the latching position, i.e., in a downward direction toward the striker 740. The force from the springs 760 holds the locking lip 728 of the pawl member 710 engaged with the locking tip 745 of the striker 740. Also, the spring 815 biases the handle 810 downward and away from the pawl tip 712. In the latched position, there is a space or gap between the flattened upper surface 832 of the handle 810 and the pawl tip 712. This arrangement helps to provide confirmation or an indication that the locking lip 728 of the pawl member 710 is engaged with the locking tip 745 of the striker 740, as the user may feel that the handle 810 is not under a downward bias from the pawl tip 712 pressing against the handle 810.

Figure 8B:
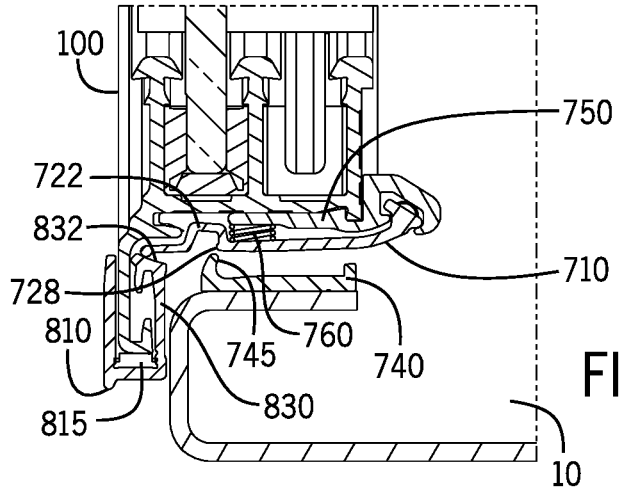
FIG. 8B is a view of the third latch releasing from the latched position.

FIG. 8B is a view of the third latch 700 releasing from the latched position. The user has pushed the handle 810 upward, thus compressing the spring 815 and pressing the handle 810 against the pawl tip 712 to rotate the pawl member 710 upward and disengage with the locking tip 745 of the striker 740.

Figure 8C:
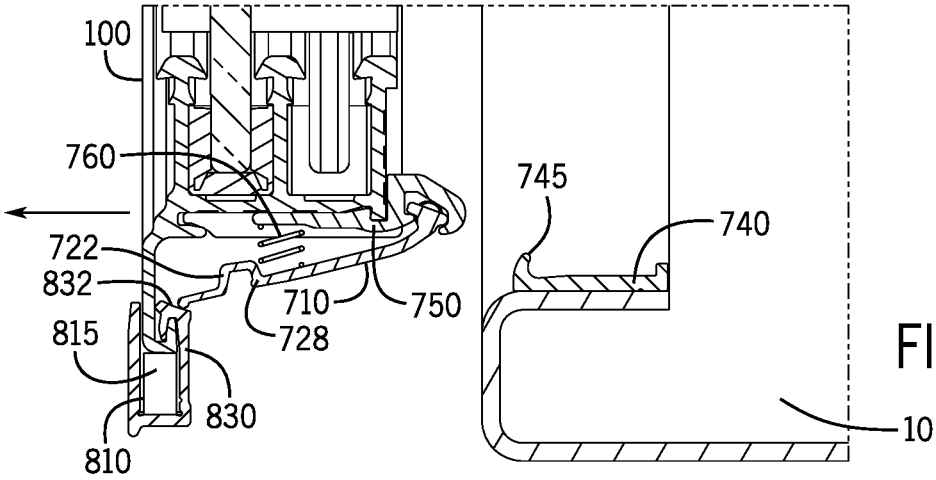
FIG. 8C is a view of the third latch in an open position.

FIG. 8C is a view of the third latch 700 and the door 100 in an open position. The user has released the handle 810. The spring 815 biases the handle 810 downward and away from the pawl tip 712. The biasing force from the springs 760 has rotated the pawl member 710 downward. When desired, the door 100 may be moved to the closed position to engage the locking lip 728 of the pawl member 710 with the locking tip 745 of the striker 740.

The third latch 700 includes a decoupled design—in that the handle 810 and the pawl member 710 becomes completely separated, removed, distanced, etc. from the striker 740 when the third latch 700 is unlatched and the door 100 is opened. The handle 810 and pawl member 710 move with the door 100, while the striker 740 remains engaged to the cabinet 10. The handle 810 and the pawl member 710 may contact the striker 740 during a closing of the door 100, but the handle 810 is not mechanically attached or integrated with the striker 740.

Figure 9:
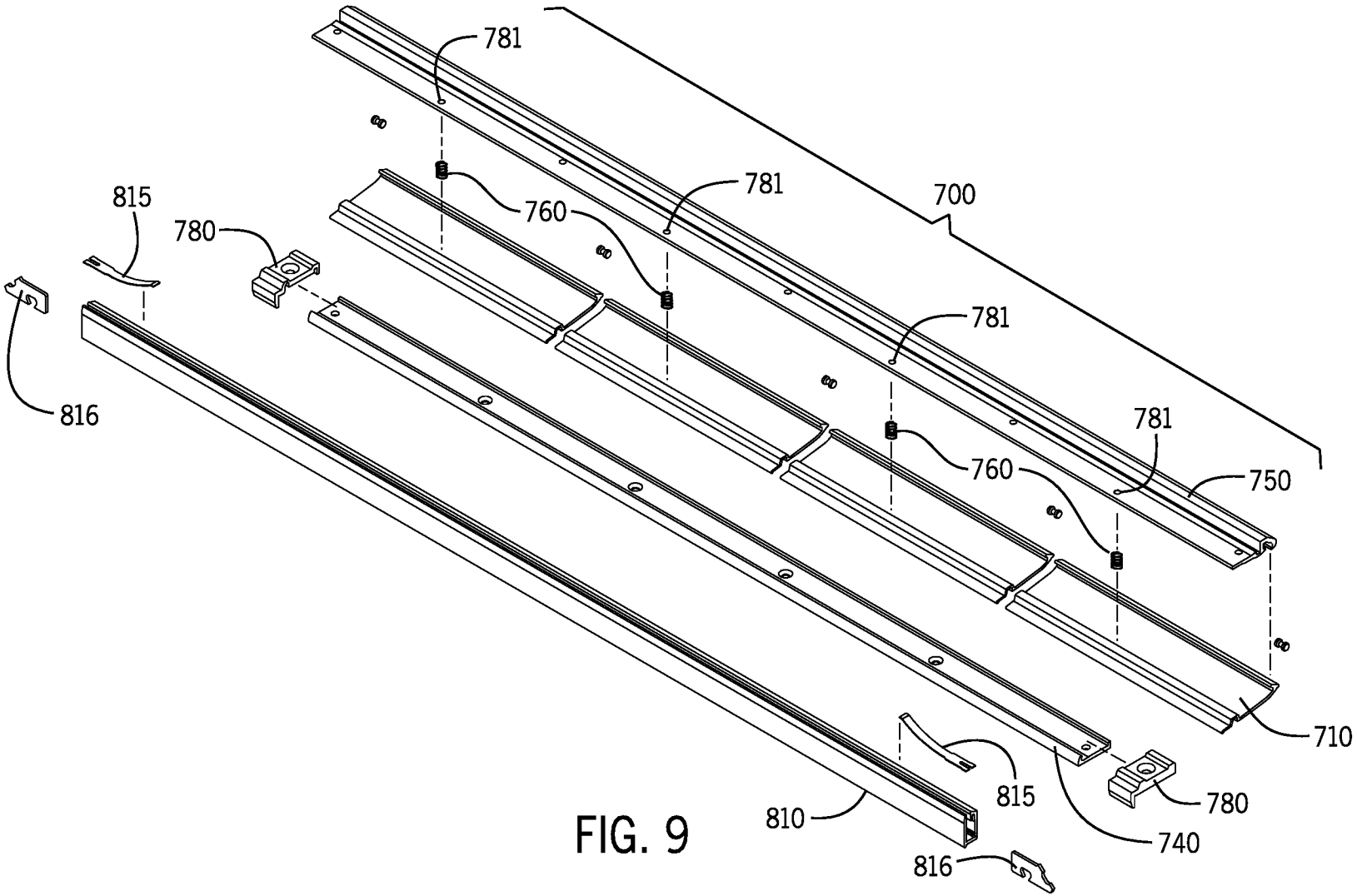
FIG. 9 is an exploded view of the third latch.

As shown in FIG. 9, the pawl member 710 may include one or more sections. This provides flexibility when using the third latch 700 with different sized doors 100. Additional sections of the pawl member 710 may be used for lager doors 100 to provide additional security.

The third latch 700, and the other latches described herein, may be used with any of a variety of cabinets and doors. For example, the third latch 700 may be installed on a cabinet and door in which the door swings down to open. In this arrangement, the third latch 700 is installed along an upper edge of the door and cabinet. Gas springs or other dampers may be used to assist the opening of the door. In other examples, the third latch 700 may be installed on a cabinet with a single door that swings out laterally, i.e., the door swings to the left or to the right. In this installation, the third latch 700 may be installed along an upper or lower edge of the door and cabinet with a hinge on the left or right side. In other examples, the third latch 700 may be installed on a cabinet with double doors that swing out, i.e., one door swings to the left and the other door swings to the right. In this installation, the third latch 700 may be installed along upper or lower edges of the door and cabinet with hinges on the left and right sides.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed:

1. A cabinet with a door, comprising:
- a cabinet comprising an upper wall and a lower wall;
- a door hingedly connected to the cabinet by a hinge connecting the upper wall of the cabinet with an upper side of the door;
- a latch for the cabinet and the door, comprising:
  - a pawl member that pivots or rotates relative to a pivot plate, the pivot plate attached to the door;
  - the pawl member includes a pawl tip generally opposite of a pawl fulcrum end;
  - a striker, wherein the pawl member engages and disengages with the striker, the striker affixed to the lower wall;
  - a handle configured to move, the handle movably engaged to the door, the handle comprising an upper end; and,
  - the upper end configured to contact the pawl tip to cause the pawl member to pivot or rotate relative to the pivot plate to disengage the pawl member from the striker.

2. The cabinet with a door according to claim 1, wherein the pawl member includes a catch portion between the pawl tip and the pawl fulcrum end.

3. The cabinet with a door according to claim 2, wherein the catch portion engages with the striker.

4. The cabinet with a door according to claim 1, wherein the upper end of the handle presses against the pawl tip, which raises or lifts the pawl member.

5. The cabinet with a door according to claim 1, wherein the pawl tip is biased in a downward direction to secure the door engaged to the cabinet.

6. The cabinet with a door according to claim 1, wherein the pivot plate defines a socket, which pivotally or rotatably holds the pawl fulcrum end of the pawl member.

7. The cabinet with a door according to claim 1, wherein the pawl member is biased toward the striker.

8. The cabinet with a door according to claim 7, wherein one or more springs are between the pawl member and the pivot plate.

9. A latch for a cabinet, comprising:
- a pawl member that pivots or rotates relative to a pivot plate;
- the pawl member includes a pawl tip generally opposite of a pawl fulcrum end;
- a striker, wherein the pawl member engages and disengages with the striker;
- a handle configured to move, the handle comprising an upper end; and, the upper end configured to contact the pawl tip to cause the pawl member to pivot or rotate relative to the pivot plate to disengage the pawl member from the striker;

wherein the pawl member includes a catch portion between the pawl tip and the pawl fulcrum end, wherein the catch portion engages with the striker; and, wherein the catch portion is a curved or arched section in the pawl member, the catch portion includes a concave surface that receives the striker, the concave surface guides the pawl member to engage a locking lip of the concave surface with a locking tip of the striker.

10. The latch for a cabinet according to claim 9, wherein the locking tip of the striker and the locking lip of the pawl member are formed with contacting surfaces at complementary reverse angles that lockingly engage one another.

11. A cabinet comprising the latch according to claim 9.

12. A latch for a cabinet, comprising:

a pawl member that pivots or rotates relative to a pivot plate;

the pawl member includes a pawl tip generally opposite of a pawl fulcrum end;

a striker, wherein the pawl member engages and disengages with the striker;

a handle configured to move, the handle comprising an upper end; and, the upper end configured to contact the pawl tip to cause the pawl member to pivot or rotate relative to the pivot plate to disengage the pawl member from the striker; and, wherein the pawl member includes an upper surface, the pivot plate includes a lower surface, and one or more springs are positioned between the upper surface and the lower surface, and the one or more springs bias the pawl member downward.

13. The latch for a cabinet according to claim 12, wherein the one or more springs bias the pawl member downward to engage the pawl member with the striker.

14. A cabinet comprising the latch according to claim 12.

15. A cabinet with a door, comprising:

a cabinet comprising an upper wall and a lower wall;

a door hingedly connected to the cabinet by a hinge connecting the upper wall of the cabinet with an upper side of the door;

a striker affixed to the lower wall;

a pivot plate affixed to the door;

a pawl member that pivots relative to the pivot plate to engage and disengage from the striker;

the pawl member includes a pawl tip generally opposite of a pawl fulcrum end;

a handle movably engaged to the door, the handle member comprising an upper surface; and, the upper surface configured to contact the pawl tip to cause the pawl member to pivot relative to the pivot plate to disengage the pawl member from the striker.

16. The cabinet with the door according to claim 15, wherein the handle includes an inner wall and an outer wall that defines an interior space, a spring is housed in the interior space, wherein the spring biases the handle away from a lower surface of the door.

17. The cabinet with the door according to claim 16, wherein the inner wall of the handle transitions into the upper surface, the handle movable relative to the door, the upper surface of the handle is configured to contact the pawl tip to cause the pawl member to pivot relative to the pivot plate to disengage the pawl member from the striker.

18. The cabinet with the door according to claim 15, wherein the pawl member includes an upper surface, the pivot plate includes a lower surface, and one or more springs are positioned between the upper surface and the lower surface, the one or more springs bias the pawl member downward, and additional springs between the door and the handle bias the handle downward.

19. The cabinet with the door according to claim 18, wherein a closing of the door compresses the one or more springs and engages the pawl member to the striker.

* * * * *